United States Patent [19]

Bean

[11] 4,327,509

[45] May 4, 1982

[54] RIPPER TOOTH ATTACHMENT FOR A BACK HOE

[76] Inventor: Rufus C. Bean, P.O. Box 100, Clipper Mills, Calif. 95930

[21] Appl. No.: 164,590

[22] Filed: Jun. 30, 1980

[51] Int. Cl.[3] ..... E02F 3/76

[52] U.S. Cl. ..... 37/117.5; 37/2 R; 37/DIG. 3

[58] Field of Search ..... 37/117.5, 2 R, DIG. 3, 37/DIG. 12

[56] References Cited

U.S. PATENT DOCUMENTS

| | | | |
|---|---|---|---|
| 2,966,180 | 12/1960 | Bles | 37/2 R X |
| 3,039,210 | 6/1962 | Slaughter | 37/117.5 |
| 4,038,766 | 8/1977 | Felstet | 37/117.5 X |
| 4,204,348 | 5/1980 | Lydie | 37/117.5 |

FOREIGN PATENT DOCUMENTS

| | | | |
|---|---|---|---|
| 624993 | 9/1978 | U.S.S.R. | 37/117.5 |
| 727769 | 4/1980 | U.S.S.R. | 37/103 |

*Primary Examiner*—Clifford D. Crowder
*Attorney, Agent, or Firm*—Lothrop & West

[57] ABSTRACT

A conventional back hoe type earth moving machine is equipped with an earth fracturing ripper tooth mechanism attached to the back hoe boom and dipper so that it can not only be manipulated into working position as required but also stored out of the way, when the back hoe bucket is operated for conventional digging. Two hydraulic cylinders or rams are attached to the center pivot pin of the back hoe boom and dipper, for extending, retracting and manipulating the ripper tooth. Support for the rams is provided by a combination of the back hoe boom, the dipper and the bucket which are extended to form an "A" frame. The distal end of the "A" frame is supported by resting the back hoe bucket on the ground. The back hoe boom, dipper and bucket "A" frame, supported at each end, will resist, at the "A" frame apex, the reactive force required to move the ripper tooth into and upwardly through the material to be fractured. Additional and special ripper teeth attachments, to the earth fracturing mechanism, are provided for special digging conditions. Structure is also provided for shifting the tooth angularly in either lateral direction to enlarge the operating zone in which ripping and lifting is effected.

7 Claims, 8 Drawing Figures

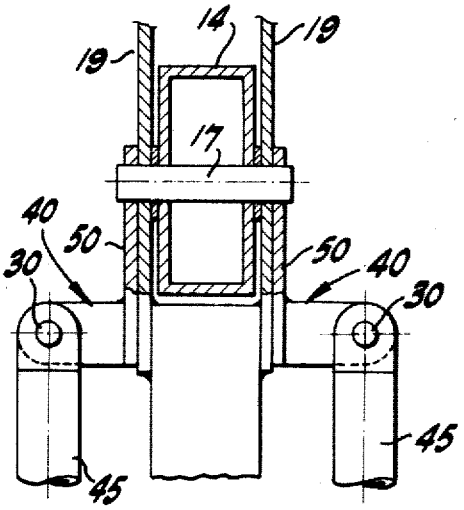
FIG-4
FIG-5
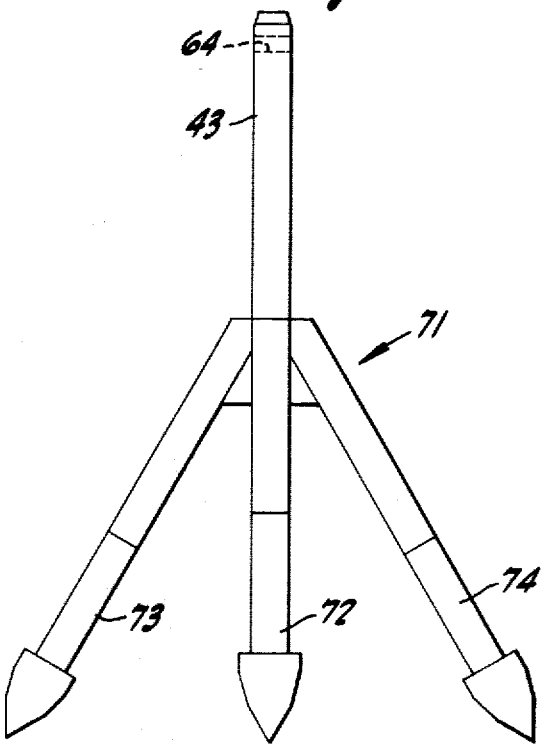
FIG-6
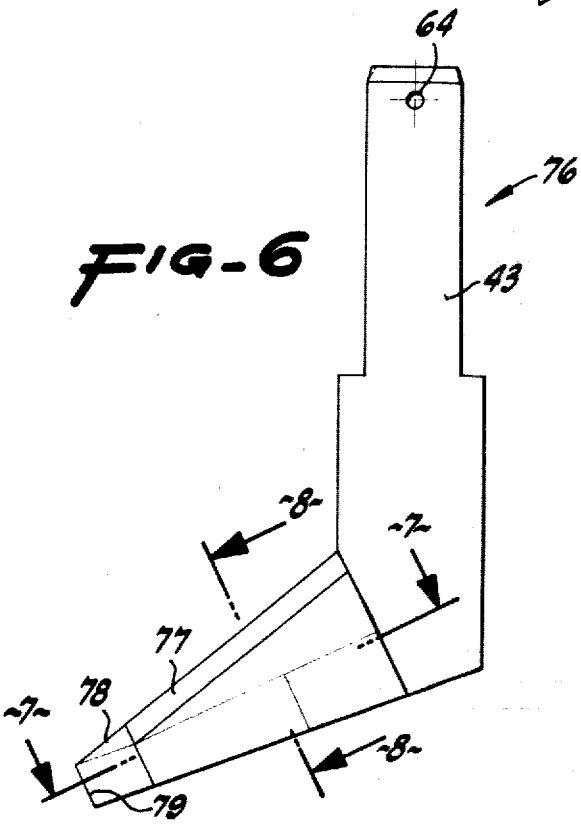
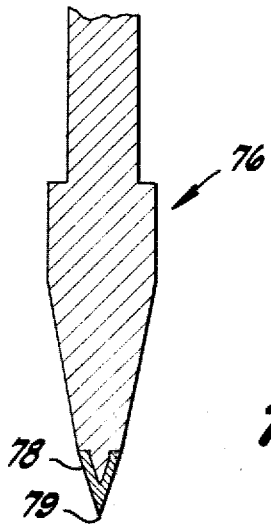
FIG-7
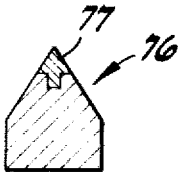
FIG-8

RIPPER TOOTH ATTACHMENT FOR A BACK HOE

BACKGROUND OF THE INVENTION

Back hoe type shovels are widely used in earth moving owing to their ability to dig swiftly and efficiently. They are particularly useful in soils, or other materials, that can be readily penetrated by the teeth of the shovel or bucket.

Efficiency is seriously impaired, however, where large rocks, roots, crustaceous layers of earth, asphalt, concrete, ice or other obstacles are encountered.

The market place as well as the patent literature are not lacking in specimens of ripper attachments for back hoe buckets designed to overcome the problems presented by crustaceous surfaces and such other impediments as are frequently encountered in the earth moving field.

U.S. Pat. No. 3,596,996 to Carter, for example, discloses a ripper attachment for a back hoe. It should be noted, however, that the lifting and fracturing effort exerted by the attachment in the Carter patent is limited by the force available at the bucket. That is to say, the vertical ripping effort of the attachment is restricted as a result of the bucket's being located at the end of the dipper which, in turn, is pivoted on the end of the boom. The resultant long moment arm can lift the bucket and the attachment with a considerable amount of force but where large tree roots or very heavy rocks are encountered, the geometry of the elongated moment arm, when taken in conjunction with the available counterbalancing weight of the carrying vehicle, necessarily imposes an upper limit which sometimes falls short of the lifting effort required to do the job.

In summary, there is considerable room for improvement.

SUMMARY OF THE INVENTION

The present invention contemplates a ripper tooth attachment to a back hoe dipper for the purpose of assisting the back hoe bucket in digging through encountered obstacles and difficult soil conditions. The ripper tooth mechanism is arranged to load the back hoe boom and dipper at their optimum design stress points by being attached at one end to the center pivot pin connecting the boom and the dipper, and being attached at the other end to the bucket end of the dipper.

Another advantage of being thus attached is that the ripper tooth can be swung from an extended working position to a stored, or out-of-the-way, position thereby allowing the back hoe bucket to be conventionally operated.

A further and major advantage of being thus attached is that the back hoe boom and dipper can be maneuvered to form an "A" frame with the toe of the back hoe bucket resting upon the ground to support one leg of the "A" frame while the other leg of the "A" frame is supported by the tractor on which the back hoe is mounted.

An "A" frame is an ideal structure to support, at its apex, the heavy force required to remove embedded obstacles or to fracture the earth. The "A" frame, in other words, greatly enhances the lifting and fracturing capabilities as contrasted with the cantilevered structure disclosed in Carter U.S. Pat. No. 3,596,996, for example. The heavy lift force is provided by a pair of hydraulic cylinders, or rams, attached at on end to the apex of the "A" frame and connected at the other end to the ripper tooth, with the two rams pulling in unison to apply the lifting or ripping force.

The dual rams also perform another function, achieved by moving one ram while locking the other, resulting in shifting or orienting the ripper tooth from side to side so as to exert its ripping force at the edges, as well as the center, of a trench.

Other attachments to the present invention include a single shank ripper-scarifier with multiple teeth for accelerated digging in hardpan, soft bedrock and highly compacted or frozen soil and a wedge-shaped ripper tooth with cutting edges for splitting and removing large stumps that cannot be lifted out intact.

It is also to be noted that in some cases, particularly in stump removal, earth moving equipment, such as a bulldozer, can mount a ripper tooth on the usual rear end hydraulically actuable hitch so that by appropriate manipulation of the hitch the tooth can be inserted under a stump and then lifted so as to split the stump, thereby facilitating its removal, or to ram into the trunk of a stump and thus effect splitting of the stump or roots.

BRIEF DESCRIPTION OF THE DRAWING FIGURES

FIG. 4 is a fragmentary front elevational view, to an enlarged scale, of the hydraulic ram yoke;

FIG. 5 is a front elevational view of a single shank, multiple tooth, ripper-scarifier attachment;

FIG. 6 is a side elevational view of a stump-splitting ripper tooth attachment;

FIG. 7 is a fragmentary sectional view of the stump-splitting ripper tooth, to an enlarged scale, the plane of the section being indicated by the line 7—7 in FIG. 6; and, FIG. 8 is a sectional view of the stump-splitting ripper tooth, to an enlarged scale, the plane of the section being indicated by the line 8—8 in FIG. 6.

DETAILED DESCRIPTION OF PREFERRED EMBODIMENT

Figure 1:
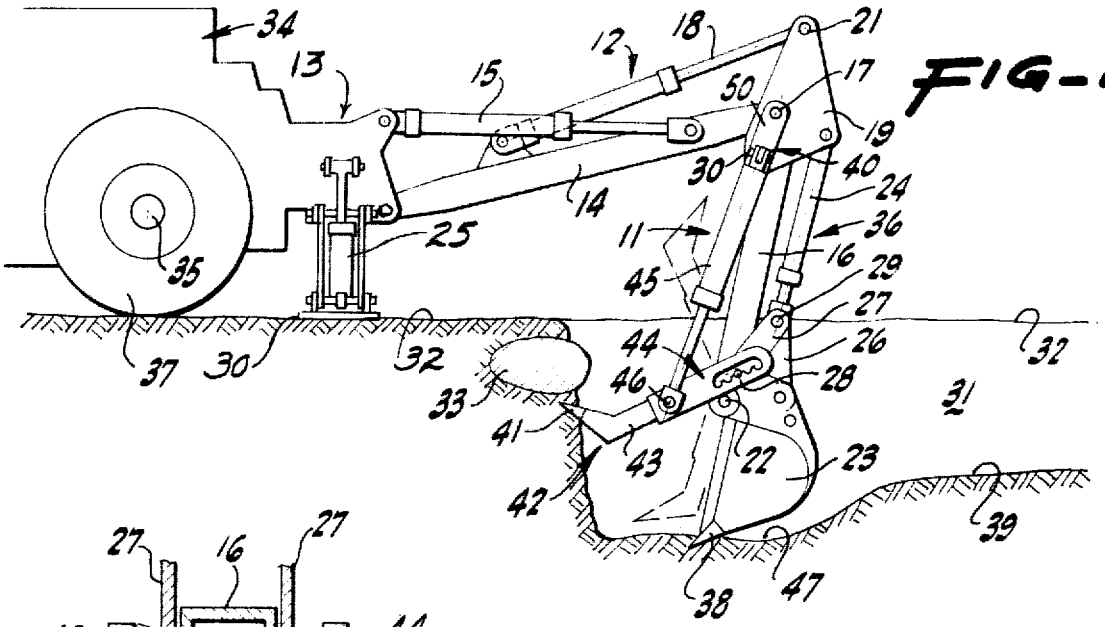
FIG. 1 is a fragmentary side elevational view of the back end of a tractor-propelled back hoe with the present ripper tooth mechanism attached thereto.

The ripper tooth attachment of the invention, generally designated by the reference numeral 11, is shown in FIG. 1 as being mounted on a conventional tractor-propelled back hoe 12.

In customary fashion, the back hoe unit 12 includes a wheel-supported frame 13, a boom 14 projecting rearwardly, the boom 14 being supported and positioned by a hydraulic ram 15, and a dipper 16 pivotally connected to the after portion of the boom 14 by a central pivot pin 17.

The angle of the dipper 16 is controlled by a hydraulic ram 18 pivotally connected at its after end to a spaced pair of lever plates 19 by a pivot pin 21. The two lever plates 19, in turn, are pivotally mounted on the pivot pin 17 and are secured to the dipper 16 so that the dipper 16 moves in unison with the lever plates 19 in response to the ram 18, the ram 18 being pivotally mounted at its forward end on the boom 14.

Pivotally mounted on the distal end of the dipper 16 by a pin 22 is a bucket 23. The angular position of the bucket 23 relative to the dipper 16 is established by a ram 24, a pivotal connection between the ram 24 and the bucket 23 being afforded by a lever 26 steadied by a guide yoke 27 pivotally connected at one end to the dipper 16 by a pivot pin 28 and at the other end to the ram 24 by a pivot pin 29. By selectively projecting and retracting the bucket-connected ram 24, the bucket angle is established, in well-known manner.

A back hoe is an efficient device when moving relatively soft and homogenous soil; for example, when digging a trench 31 in the ground 32 and the earth is not tightly compacted. However, when a difficult-to-move obstacle is encountered, such as a rock 33 as shown in FIG. 1, the geometry of the usual back hoe mechanism imposes a serious limitation on the ability of the bucket to dislodge and lift the heavy object out of the trench path.

That is to say, the boom-dipper-bucket assembly is cantilevered from the tractor-mounted frame 13 and thus the ultimate dislodging and lifting force which can be brought to bear on the object 33 by the bucket 23 is measured by the counterweight afforded by the portion of the tractor 34 forward of a pair of hydraulically-actuated outriggers 25, or jacks, each provided with a ground-engaging foot-plate 30, or pad, for stabilizing the back hoe, in well-known manner.

No such limitation applies in the case of the attachment of the present invention 11 owing to the fact that the dislodging and lifting effort exerted by the present ripper tooth is impossed on the apex of an "A" frame, generally designated by the reference numeral 36.

One leg of the triangular "A" frame 36 is defined by the ground-engaging pad 30, the outrigger 25, and the boom 14, the apex of the triangle coinciding with the pivot pin 17 on the end of the boom 14.

The other, or dipper, leg of the "A" frame 36 is defined by the dipper 16 and the bucket 23. The bucket teeth 38 at the tip of the bucket are often used, as in FIG. 1, to support the dipper leg of the "A" frame. In sandy or wet soil conditions, however, the bottom surface of the bucket 23 can be used to support the dipper leg of the "A" frame.

The embedded obstacle 33 is engaged, dislodged and lifted from below by the spade-like tip 41 of a ripper tooth 42 projecting forwardly from the distal end of a tool shank 43 removably attached to a ripper tooth yoke 44 pivotally associated with the pivot pin 28.

The lifting effort on the ripper tooth 42 is provided by a pair of hydraulic rams 45 pivotally connected at one end to the ripper tooth yoke 44 by a pivot pin 46 and at the other end on respective pivot pins 30 (see FIG. 4) carried on a bracket 40 having side plates 50 pivotally mounted on the central pivot pin 17 forming the apex of the "A" frame.

In the position of the unit as depicted in full line in FIG. 1, the majority of the load exerted on the pin 17, as the dual rams 45 are retracted so as to elevate the ripper tooth spade 41 upwardly into engagement with the underside of the rock 33, is transferred downwardly through the dipper 16, the bucket 23 and the bucket tip 38 supported by the underlying earth.

The full force of the rams 45 can thus be brought to bear on the rock 33, without concern as to what counterweight or counterbalance might be available, as is the concern where the ripper is attached to the bucket in a cantilever situation.

Another beneficial aspect of the present arrangement is that by full retracting the rams 45, the ripper tooth can be pivoted forwardly and upwardly into stored or out-of-the-way attitude as shown in the upper set of broken lines in FIG. 1. In this position, the bucket 23 can be maneuvered with all the ease provided in a back hoe lacking the ripper tooth attachment.

Thus, in the absence of any obstacles, such as the rock 33, the bucket would carve out the trench 31 to an even depth, such as that shown in the right-hand end portion of FIG. 1.

However, should a object such as the rock 33 be encountered by the bucket 23, the operator merely lowers the bucket 23 and scoops out a depression 47 sufficient to provide clearance for the ripper tooth 42 as it is lowered from the stored upper position shown in broken line to the operative lower position also shown in broken line (see FIG. 1). The components making up the "A" frame are then positioned so that with the dipper leg of the "A" frame supported by the ground, the tip 41 of the ripper tooth 42 is placed in an arc which will cause the tooth to engage the bottom of the rock 33, as appears in full line in FIG. 1. In other words, as the rams 45 are retracted, the ripper tooth 42 first swings upwardly and forwardly into the position shown in full line in FIG. 1 and then upwardly with dislodging force against the bottom of the rock 33.

After the rock 33 is removed, the ripper tooth can be returned to its stored, or out-of-the-way, position, as previously explained. The earth moving equipment can then resume trenching, as before.

Figure 2:
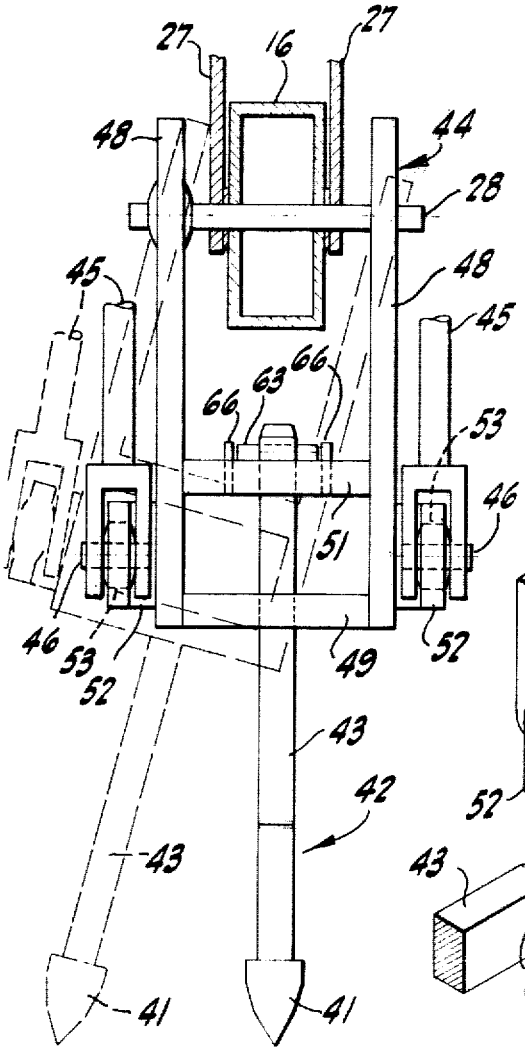
FIG. 2 is a fragmentary front elevational view, to an enlarged scale, of the ripper tooth yoke and associated structure illustrating how the tooth can be angularly shifted to the side.

FIG. 2 illustrates the structure which enables the ripper yoke 44 and ripper tooth 42 to be swung laterally to either side, as shown in broken line, thereby extending the reach of the tooth blade 41 several inches to either side of the customary fore and aft orientation shown in full line.

Figure 3:
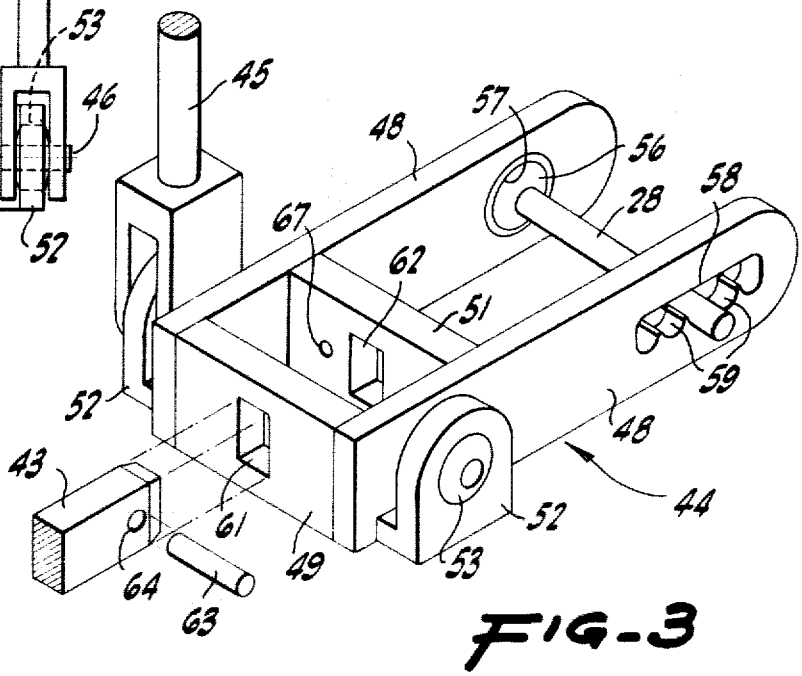
FIG. 3 is a fragmentary, isometric, partially exploded view, to an enlarged scale, of the ripper tooth yoke illustrating the manner in which different kinds of teeth can be mounted on the yoke interchangeably.

In other words, as shown most clearly in FIGS. 2 and 3, the ripper tooth yoke 44 includes in addition to a spaced pair of side plates 48, a forward transverse plate 49 and an after transverse plate 51, the transverse plates 49 and 51 being firmly secured to the side plates 49, as by welding, to afford a strong, rigid yoke structure.

An opposite pair of brackets 52, or ears, mounted on the forward lateral portion of the side plates 48 provides a pair of bearings 53 in which the two pivot pins 46 are journaled. As previously explained, the pins 46 pivotally carry the lower ends of the two ripper tooth actuating rams 45.

Lateral, angular shifting of the ripper tooth 42 is made possible owing to the provision of a ball-pivot 56 located within a congruent opening 57 in the after end of one of the side plates 48 (see FIGS. 2 and 3).

The pivot pin 28 is secured to the ball-pivot 57, and remains in a fixed transverse position, extending through the guide yoke 27 and the end of the dipper 16 as shown in FIG. 2. The yoke 44 itself however, can be angularly shifted because the end of the pivot pin 28 remote from the ball-pivot 56 is located in a fore and aft slot 58 in the adjacent one of the side plates 48 (see FIG. 3), the slot including notches 59 on the lower surface.

Actual shifting of the yoke 44 is effected by appropriately retracting and immobilizing the opposite ones of the two ripper tooth rams 45. Thus, in order to shift the ripper tooth 42 from the central, fore and aft orientation shown in FIG. 2 in full line to the laterally displaced position shown in broken line in FIG. 2, the two rams 45 are first extended to a nearly fully extended position, equal in amount, the end of the pin 28 being thereby positioned in the central notch 59, as appears in FIG. 3. The left-hand one of the rams 45 is then retracted while the right-hand one of the rams is hydraulically locked, causing the ripper tooth 42 to swing to the left, as in FIG. 2. For movement to the right, the opposite procedure is followed.

As the ripper tooth 42 and yoke 44 are swung either to right or left, as previously described, the end of the pin 28 in the slot 58 is caused to align with the proper notch 59. Once the ripper tooth is in shifted position, operation of the rams 45 in unison will actuate the shifted tooth as desired.

When the ripper tooth rams 45 are projected to an identical length, the pin 28 is located centrally, as in FIG. 3. Thereafter, when the dual rams 45 are actuated in unison, the ripper tooth 42 will remain centrally oriented as the ripper tooth is swung to the desired location against an obstacle.

FIGS. 2 and 3 also illustrate how a variety of ripper teeth 42 can be used interchangeably, depending upon the particular situation encountered.

The shank portion 43 of all the various different types of ripper teeth is identical, being shaped so as to be snugly inserted through registering fore and aft openings 61 and 62 in the respective transverse plates 49 and 51 of the ripper tooth yoke 44. The shank 43 is releasably secured by a cross-pin 63 passing through a transverse opening 64 in the end of the shank 43. As appears most clearly in FIG. 2, the cross-pin 63 is in engagement with the nether surface of the after transverse plate 51 and is restrained against lateral translation by a pair of limit stop pins 66, or split pins, frictionally disposed in a respective pair of holes 67 in the plate 51.

The tooth 42 heretofore described and shown in FIGS. 1 and 2 can be characterized as a general purpose tooth. For other conditions, such as for fracturing material such as hardpan, or the like, specialized forms of ripper teeth can be used.

For example, FIG. 5 illustrates a single-shank, multiple tooth arrangement, designated by the reference numeral 71, for particular use in scarifying the earth or other material being worked on. The multiple tooth 71 includes a central tooth 72 and a pair of side teeth 73 and 74, extending angularly from the tool shank 43, which, as previously explained, allows various different types of ripper teeth to be used interchangeably.

Still another form of ripper tooth is shown in FIGS. 6, 7 and 8. This type of especially suitable for splitting stumps and is designated by the reference numeral 76. As before, the stump splitting tooth 76 includes the shank 43. However, this form of this tooth is wedge-shaped in transverse section, as appears in FIG. 8 and includes a replaceable top cutting edge portion 77 of hardened material. This facilitates cutting a stump or roots into two or more pieces by lifting up on the tooth after inserting the tooth underneath the central portion of the stump or under roots. In other words, if the very considerable upward force exerted on the bottom of the stump as the tooth rams 45 are retracted (and with the bucket supported on the ground to complete the "A" frame 36, as previously described) does not vertically dislodge the entire stump from the ground, it is likely that the sharp tip 77 will cause the stump to rupture and split.

The stump splitting tooth 76 also tapers or converges forwardly, as appears in FIGS. 6 and 7. Here again, a sharp replaceable tip 78 is afforded. This forwardly extending cutting edge is especially useful in splitting stumps by driving the sharp edge 79 into the side of the stump rather than from below the stump in the fashion previously mentioned.

Thus, this form of tooth could be mounted either in the arrangement of the ripper tooth 42, or, by the use of suitable adapters, to the hydraulically actuable hitch of a bulldozer. Then, by appropriate manipulation of the hydraulic system, the stump splitting tooth could be used either for driving the wedge 78 into the trunk of the stump or lifting the wedge 77 from below the center of the stump. In similar fashion, roots can be cut or wooden debris just below the earth's surface can be fractured and dislodged.

It can therefore be seen that rocks, roots, crustaceous layers of earth, asphalt, concrete, ice and buried rubble, as well as other obstacles or discontinuities can readily by disposed of.

The "A" frame arrangement of the elements, as used in conjunction with a conventional back hoe, expands to a very considerable extent the forces which can be brought to bear on the articles to be dislodged and the counterweight limitations heretofore existing in back hoe attachments have been substantially eliminated.

I claim:

1. Ripper tooth attachment for a back hoe including a back hoe frame, and an articulated back hoe boom, dipper and bucket, said attachment comprising:

a. an elongated shank having a ripper tooth on one end;

b. yoke means for mounting the other end of said shank on the end of the dipper adjacent the bucket for pivotal movement relative thereto, said yoke means including a pair of elongated side plates, one of said side plates including an elongated notched slot, the other of said side plates including a ball pivot opposite said slot, and a pivot pin journaled on the dipper adjacent the back hoe bucket, one end of said pivot pin being connected to said ball pivot and the other end projecting through said slot; and, c. a pair of hydraulic rams pivotally mounted at one end on opposite ends of the center pivot pin of the boom and the dipper and at the other end on opposite sides of said side plates, retraction of one of said rams and the simultaneous immobilization of the other of said rams being effective to shift said yoke means angularly laterally, said rams being effective to move said ripper tooth between a first fully retracted position when the back hoe bucket is operated for conventional digging, a second fully extended position when the frame and boom form one leg of an "A" frame and the dipper and the bucket form the other leg of the "A" frame with the bucket supported by the ground, and a third partially extended position in which said ripper tooth is moved forwardly and upwardly by said rams into lifting engagement with the material to be fractured while said rams are supported by the "A" frame.

2. A ripper tooth attachment as in claim 1 in which said ripper tooth includes a single central tooth having a spade-like tip.

3. A ripper tooth attachment as in claim 1 in which said ripper tooth includes a central tooth and a pair of laterally angularly projecting teeth arranged in mirror symmetry on opposite sides of said central tooth.

4. A ripper tooth attachment as in claim 3 in which all three of said teeth have a spade-like tip.

5. A ripper tooth attachment as in claim 1 in which said ripper tooth includes a single central tooth wedge-shaped in transverse cross-section with the apex sharpened and directed upwardly to split a superposed stump when said tooth is elevated into engagement with the bottom of the stump.

6. A ripper tooth attachment as in claim 5 in which said single central tooth converges rearwardly to a sharpened vertical edge capable of splitting a stump when forcefully applied against said stump.

7. A ripper tooth attachment for a back hoe including a frame, a boom pivotally mounted at one end on the frame, a lever plate pivotally mounted on the other end of the boom, a dipper mounted at one end on the lever plate, and a bucket pivotally mounted on the other end of the dipper, the boom, the lever plate, the dipper and the bucket being selectively movable relative to each other in the same vertical plane, said attachment comprising:

a. a ripper tooth extending between a shank end and a tip end;

b. means for mounting said shank end of said ripper tooth on the dipper adjacent the other end of the dipper for movement of said ripper tooth in said vertical plane between a first attitude, in which said ripper tooth extends over the bucket in substantial alignment with the dipper, a second attitude in which said ripper tooth is substantially at right angles relative to the dipper, and a third attitude in which said ripper tooth approaches coincidence with the dipper; and, c. a hydraulic ram mounted at one end on said lever plate and at the other end on said ripper tooth intermediate said shank end and said tip end thereof, said ram lying substantially in said vertical plane as said ram moves between a first fully extended position corresponding to said first attitude of said ripper tooth, a second partially retracted position corresponding to said second attitude of said ripper tooth and a third fully retracted position corresponding to said third attitude of said ripper tooth, said one end of said ram being supported by said lever plate forming the apex of an "A" frame in which one leg of the "A" frame is defined by the ground-supported back hoe frame and associated boom and the other leg of the "A" frame is defined by the ground-supported bucket and associated dipper, the reactive stress imposed on said ram as resistive force is exerted by an obstacle encountered by said ripper tooth as said ram is urged toward retracted position being transferred to the apex of the "A" frame and thence through both legs of the "A" frame to the ground.

* * * * *